US011499469B2

(12) United States Patent
Chu

(10) Patent No.: US 11,499,469 B2
(45) Date of Patent: Nov. 15, 2022

(54) APPARATUS FOR CONTROLLING ENGINE COOLING OF A VEHICLE, A SYSTEM HAVING THE SAME AND A METHOD THEREOF

(71) Applicants: HYUNDAI MOTOR COMPANY, Seoul (KR); KIA MOTORS CORPORATION, Seoul (KR)

(72) Inventor: Ji Ro Chu, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 162 days.

(21) Appl. No.: 17/035,013

(22) Filed: Sep. 28, 2020

(65) Prior Publication Data

US 2021/0388752 A1 Dec. 16, 2021

(30) Foreign Application Priority Data

Jun. 15, 2020 (KR) ..... 10-2020-0072559

(51) Int. Cl.

| | |
|---|---|
| ***F01P 3/20*** | (2006.01) |
| ***F01P 1/00*** | (2006.01) |
| ***F04D 27/00*** | (2006.01) |
| ***F01P 7/04*** | (2006.01) |
| ***F01P 5/04*** | (2006.01) |

(52) U.S. Cl.

CPC ..... *F01P 7/048* (2013.01); *F01P 5/04* (2013.01); *F01P 2005/046* (2013.01); *F01P 2025/32* (2013.01); *F01P 2025/64* (2013.01)

(58) Field of Classification Search

CPC .. F01P 2023/00; F01P 3/20; F01P 1/00; F04D 27/004; B60H 2001/3282; B60H 1/00428

See application file for complete search history.

(56) References Cited

U.S. PATENT DOCUMENTS

| | | | | |
|---|---|---|---|---|
| 2003/0133242 | A1* | 7/2003 | Buchholz | F01P 7/042 361/103 |
| 2005/0254959 | A1* | 11/2005 | Furuta | F01P 7/044 417/42 |
| 2006/0062678 | A1* | 3/2006 | Furuta | E02F 9/24 417/42 |
| 2012/0288377 | A1* | 11/2012 | Hartman | F01P 7/026 417/13 |
| 2016/0363037 | A1* | 12/2016 | Chu | F01P 11/10 |
| 2018/0043751 | A1* | 2/2018 | Steinmetz | F01P 7/165 |
| 2019/0187642 | A1* | 6/2019 | Lee | G05B 19/0426 |
| 2020/0256407 | A1* | 8/2020 | Takahashi | F16D 48/064 |

* cited by examiner

*Primary Examiner* — Long T Tran

(74) *Attorney, Agent, or Firm* — Lempia Summerfield Katz LLC

(57) ABSTRACT

An engine cooling control apparatus, a system including the same, and a method thereof provide an engine cooling control apparatus including a processor configured to calculate a required fan rotation speed for controlling a cooling fan based on proportional integral (PI) control and a storage configured to store data acquired by the processor and an algorithm for driving the processor. The processor classifies a plurality of control regions depending on a coolant temperature and adjusts and outputs the required fan rotation speed for each of the control regions.

17 Claims, 5 Drawing Sheets

| Coolant temperature Y-axis | 40(km/h) | 60 | 80 | 100 | 110 |
|---|---|---|---|---|---|
| Zone C (equal to or greater than 90 degrees) | Outputting required fan rotation speed based on PI control | | | | |
| Zone B (equal to or greater than 60 and smaller than 90 degrees) | Required fan rotation speed based on PI control * ratio | | | | |
| Zone A (smaller than 60 degrees) | Desired fan rotation speed directly inputted by user | | | | |

FIG. 2

ZONE B:
THIRD REQUIRED FAN ROTATION SPEED = SECOND REQUIRED FAN ROTATION SPEED GENERATED BY PI CONTROL X ATTENUATION COEFFICIENT

WHEN TARGET COOLANT TEMPERATURE IS 100 DEGREES

| TEMPERATURE | | VEHICLE SPEED | | | | | |
|---|---|---|---|---|---|---|---|
| CONTROL REGION | COOLANT TEMPERATURE | 40KM/H | 60 | 80 | 90 | 110 | 110~ |
| ZONE C | 90 | OUTPUT SECOND REQUIRED FAN ROTATION SPEED | | | | | |
| ZONE B | 80 | 0.0 ~ 1.0 | | | | | |
| | 70 | | | | | | |
| | 60 | | | | | | |
| ZONE A | 50 | 200 | 200 | 220 | 250 | 280 | 300 |
| | >40 | 150 | 150 | 150 | 150 | 150 | 150 |

ZONE A:
DIRECTLY INPUT REQUIRED FAN ROTATION SPEED AND NEGLECT VALUE OUTPUTTED BY PI CONTROL

FIG. 4

APPARATUS FOR CONTROLLING ENGINE COOLING OF A VEHICLE, A SYSTEM HAVING THE SAME AND A METHOD THEREOF

CROSS-REFERENCE TO RELATED APPLICATION

This application claims priority to and benefits of Korean Patent Application No. 10-2020-0072559 filed in the Korean Intellectual Property Office on Jun. 15, 2020, the entire contents of which are incorporated herein by reference.

BACKGROUND

(a) Field of the Disclosure

The present disclosure relates to an engine cooling control apparatus, a system including the same, and a method thereof, and more particularly, to a technique capable of precisely controlling a speed of a cooling fan of a vehicle.

(b) Description of the Related Art

An electronically controlled fluid-type fan clutch is applied to a large truck that is currently in production for the purpose of improving fuel efficiency. The electronically controlled fluid-type fan clutch controls a speed of a cooling fan to maintain a target temperature through electronic control unit (ECU) control (coolant temperature) and is often full-engaged to reach a target speed.

When the electronically controlled fluid-type fan clutch is pull-engaged, an engine increases power consumption and loses fuel economy and hill climbing ability. A fan clutch that was once fully-engaged maintains engagement without being disengaged for a considerable period of time during which a fluid escapes, making it difficult to control an intermediate speed of the cooling fan. Thus, noise increases due to a large change in fan speed.

The above information disclosed in this Background section is only to enhance understanding of the background of the disclosure. Therefore, The Background section may contain information that does not form the prior art that is already known in this country to a person of ordinary skill in the art.

SUMMARY

An embodiment of the present disclosure has been made in an effort to provide an engine cooling control apparatus, a system including the same, and a method thereof, capable of classifying a plurality of control regions depending on a coolant temperature, preventing a sudden change in a rotational speed of a cooling fan by adjusting a fan speed required for each of the regions, and minimizing an unnecessary cooling fan operation to improve a fuel efficiency, increase acceleration, and improve a hill climbing ability.

The technical objects of the present disclosure are not limited to the objects mentioned above. Other technical objects not mentioned can be clearly understood by those having ordinary skill in the art from the description of the claims.

An embodiment of the present disclosure provides an engine cooling control apparatus including; a processor configured to calculate a required fan rotation speed for controlling a cooling fan based on proportional integral (RI) control; and a storage configured to store data obtained by the processor and an algorithm for driving the processor, wherein the processor classifies a plurality of control regions depending on a coolant temperature, and adjusts and outputs the required fan rotation speed for each of the control regions.

In an embodiment, the processor may classify the control regions into: a region having the coolant temperature that is equal to or greater than a predetermined first threshold and smaller than a predetermined second threshold as an intermediate temperature region; a region having the coolant temperature that is below the first threshold as a low temperature region; and a region having the coolant temperature that is higher than the second threshold as a high temperature region.

In an embodiment, the processor may reduce a required fan rotation speed calculated based on the PI control in the case of the intermediate temperature region, In an embodiment, the processor may reduce the required fan rotation speed by multiplying the required fan rotation speed calculated based on the PI control by a predetermined attenuation coefficient for each vehicle speed.

In an embodiment, the attenuation coefficient may have a value of 1 or less.

In an embodiment, the processor may control driving of the cooling fan by using a required fan rotation speed that is inputted by a user in the case of the low temperature region.

In an embodiment, the processor may control the driving of the cooling fan by using the required fan rotation speed based on the PI control in the case of the high temperature region.

In an embodiment, the processor may calculate a second target coolant temperature for controlling the coolant temperature to reach the first target coolant temperature.

In an embodiment, the processor may calculate a fan rotation speed of a cooling fan by using an engine rotation speed and a pulley ratio.

In an embodiment, the processor may calculate a first required fan rotation speed based on the second target coolant temperature and may calculate a second required fan rotation speed for controlling the fan rotation speed to reach the first required fan rotation speed.

In an embodiment, the processor may output a pulse width modulation (PWM) signal for driving a fan clutch depending on the required fan rotation speed.

An embodiment of the present disclosure provides a vehicle system including an engine cooling control apparatus and an electronic fan clutch. The engine cooling apparatus is configured to calculate a required fan rotation speed for controlling a cooling fan based on proportional integral (PI) control, to classify a plurality of control regions depending on a coolant temperature, and to adjust and output the required fan rotation speed for each of the control regions. The electronic fan clutch is configured to output a control signal for controlling a cooling fan depending on the required fan rotation speed.

In an embodiment, the engine cooling control apparatus may classify the control regions into: a region having the coolant temperature that is equal to or greater than a predetermined first threshold and smaller than a predetermined second threshold as an intermediate temperature region; a region having the coolant temperature that is below the first threshold as a low temperature region; and a region having the coolant temperature that is higher than the second threshold as a high temperature region.

In an embodiment, the engine cooling control apparatus may reduce the required fan rotation speed calculated based on the PI control in the case of the intermediate temperature region; may control driving of the cooling fan by using a required fan rotation speed that is inputted by a user in the case of the low temperature region; and may control the driving of the cooling fan by using the required fan rotation speed based on the PI control in the case of the high temperature region.

An embodiment of the present disclosure provides an engine cooling control method; including: calculating a required fan rotation speed for controlling a cooling fan based on proportional integral (PI) control; classifying a plurality of control regions depending on a coolant temperature; and adjusting and outputting the required fan rotation speed for each of the control regions.

In an embodiment, the classifying of the control regions depending on the coolant temperature may include; determining a region where the coolant temperature is equal to or greater than a predetermined first threshold value or smaller than a predetermined second threshold value as an intermediate temperature region; determining a region where the coolant temperature is smaller than the first threshold value as a low temperature region; and determining a region where the coolant temperature is equal to or greater than the second threshold value as a high temperature region.

In an embodiment; the adjusting and outputting of the required fan rotation speed may include: reducing the required fan rotation speed calculated based on the PI control in the case of the intermediate temperature region; controlling driving of a cooling fan by using a required fan rotation speed that is inputted by a user in the case of the low temperature region; and controlling the driving of the cooling fan by using the required fan rotation speed based on the PI control in the case of the high temperature region.

In an embodiment, the reducing of the required fan rotation speed may include reducing the required fan rotation speed by multiplying the required fan rotation speed calculated based on the PI control by a predetermined attenuation coefficient for each vehicle speed.

In an embodiment, the attenuation coefficient may have a value of 1 or less.

In an embodiment, a pulse width modulation (PWM) signal for driving an electronic fan clutch may be output depending on the required fan rotation speed.

According to the disclosed technique, it is possible to classify a plurality of control regions depending on a coolant temperature, to prevent a sudden change in a rotational speed of a cooling fan by adjusting a fan speed required for each of the regions, and to minimize an unnecessary cooling fan operation to improve a fuel efficiency, increase acceleration, and improve a hill climbing ability.

In addition, various effects that can be directly or indirectly identified through this document may be provided.

BRIEF DESCRIPTION OF THE DRAWINGS

FIG. 2 illustrates a view for describing a method for calculating a third required fan rotation speed according to an embodiment of the present disclosure.

FIG. 4 illustrates an example of a screen of an intermediate speed control map for a cooling fan of an engine cooling control apparatus according to an embodiment of the present disclosure.

DETAILED DESCRIPTION OF THE EMBODIMENTS

Figure 1:
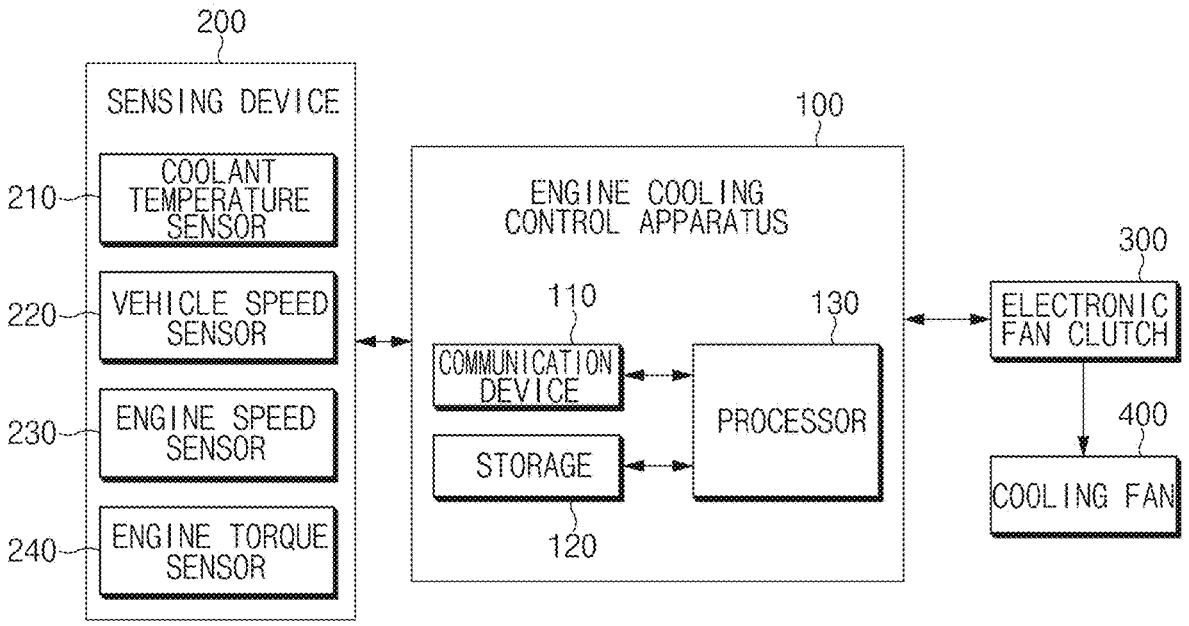
FIG. 1 illustrates a block diagram showing a configuration of a vehicle system including an engine cooling control apparatus according to an embodiment of the present disclosure.

Hereinafter, some specific embodiments of the present disclosure are described in detail with reference to the drawings. It should be noted that in adding reference numerals to constituent elements of each drawing, the same or equivalent constituent elements have the same reference numerals as possible even though they are indicated on different drawings. In addition, in describing specific embodiments of the present disclosure, when it is determined that detailed descriptions of related well-known configurations or functions interfere with understanding of the embodiments of the present disclosure, the detailed descriptions thereof have been omitted. When a component, device, element, or the like of the present disclosure is described as having a purpose or performing an operation, function, or the like, the component, device, or element should be considered herein as being "configured to" meet that purpose or to perform that operation or function. Further, the controller described herein may include a processor programmed to perform the noted operation, function, or the like.

In describing constituent elements according to an embodiment of the present disclosure, terms such as first, second, A, B, (a), and (b) may be used. These terms are only for distinguishing the constituent elements from other constituent elements, and the nature, sequences, or orders of the constituent elements are not limited by the terms. In addition, all terms used herein including technical scientific terms have the same meanings as those which are generally understood by those having ordinary skill in the technical field to which the present disclosure pertains (those having ordinary skill in the art) unless they are differently defined. Terms defined in a generally used dictionary shall be construed to have meanings matching those in the context of a related art and shall not be construed to have idealized or excessively formal meanings unless they are clearly defined in the present specification.

Hereinafter, specific embodiments of the present disclosure are described in detail with reference to FIGS. 1-5.

FIG. 1 illustrates a block diagram showing a configuration of a vehicle system including an engine cooling control apparatus according to an embodiment of the present disclosure.

Referring to FIG. 1, a vehicle system may include the engine cooling control apparatus 100, a sensing device 200, an electronic fan clutch 300, and a cooling fan 400.

The engine cooling control apparatus 100 according to the embodiment of the present disclosure may be implemented inside a vehicle. In this embodiment, the engine cooling control apparatus 100 may be integrally formed with internal control units of the vehicle or may be implemented as a separate device to be connected to control units of the vehicle by a separate connection means.

The engine cooling control apparatus 100 may calculate a required fan rotation speed for controlling the cooling fan 400 based on proportional integral (PI) control, may classify a plurality of control regions (high temperature region, intermediate temperature region, and low temperature region) depending on a coolant temperature, and may adjust and output the required fan rotation speed for each of the control regions. In other words, the engine cooling control apparatus 100 may control the cooling fan to be driven depending on the required fan rotation speed based on the PI control because an engine needs to be quickly cooled in a temperature region where the coolant temperature is high. The engine cooling control apparatus 100 may receive the required fan rotation speed directly from a user to cool it by slowly rotating a fan depending on a vehicle speed because it does not need to be quickly cooled in a temperature region where the coolant temperature is low. When the coolant temperature is in the intermediate region, the required fan rotation speed may be precisely reduced and driven by multiplying the required fan rotation speed calculated based on PI by a predetermined ratio (attenuation coefficient). Thus, a sudden change in the speed of the cooling fan 400 and unnecessary driving of the cooling fan 400 may be prevented.

The sensing device 200 may include at least one sensor for sensing a coolant temperature, a vehicle speed, an engine speed, an engine torque, and the like. The sensing device 200 may include a coolant temperature sensor 210, a vehicle speed sensor 220, an engine speed sensor 230, and an engine torque sensor 240. The sensing device 200 may include a sensor for sensing a rotation speed of the cooling fan 400.

The electronic fan clutch 300 may control an operation of the cooling fan 400 depending on a control signal of the processor 130. In addition, the electronic fan clutch 300 may include a fan rotation speed sensor (not illustrated) for sensing the rotation speed of the cooling fan 400. The electronic fan clutch 300 may sense the rotation speed of the cooling fan 400 under control of the apparatus 100, may generate cooling fan rotation speed information, and may transfer the generated cooling fan rotation speed information to the engine cooling control apparatus 100.

An operation of the cooling fan 400 may be controlled by the electronic fan clutch 300. The cooling fan 400 may variably control the coolant temperature through a rotation operation.

The engine coolant control apparatus 100 may include a communication device 110, a storage 120, and a processor 130.

The communication device 110, which is a hardware device implemented with various electronic circuits to transmit and receive signals through a wireless or wired connection, may perform V2I communication by using an in-vehicle network communication technique or a wireless Internet access or short range communication technique with servers, infrastructure, and other vehicles outside the vehicle in the present disclosure. Herein, in-vehicle communication may be performed through controller area network (CAN) communication, local interconnect network (LIN) communication, or flex-ray communication as the in-vehicle network communication technique. In addition, the wireless communication technique may include wireless LAN (WLAN), wireless broadband (Wibro), Wi-Fi, world Interoperability for microwave access (Wimax), etc. In addition, short-range communication technique may include bluetooth, ZigBee, ultra wideband (UWB), radio frequency identification (RFID), infrared data association (IrDA), and the like.

As an example, the communication device 110 may communicate with the sensing device 200 and the cooling fan 400 to receive sensing information and may transmit a control signal to the cooling fan 400.

The storage 120 may store sensing results of the sensing device 200, data obtained by the processor 130, data and/or algorithms required for the engine cooling control apparatus 100 to operate, and the like.

As an example, the storage 120 may store a correction map for correcting a target coolant temperature, a required fan rotation speed map on which a required fan rotation speed is matched for each target coolant temperature, and the like. In addition, the storage 120 may store first and second threshold values for distinguishing a plurality of control regions depending on the coolant temperature. In this embodiment, the first threshold value and the second threshold value may be pre-set by an experiment value to be stored.

The storage 120 may include a storage medium of at least one type among memories of types such as a flash memory, a hard disk, a micro, a card (e.g., an secure digital (SD) card or an extreme digital (XD) card), a random access memory (RAM), a static RAM (SRAM), a read-only memory (ROM), a programmable ROM (PROM), an electrically erasable PROM (EEPROM), a magnetic memory (MRAM), a magnetic disk, and an optical disk.

The processor 130 may be electrically connected to the communication device 110, the storage 120, and the like, may electrically control each component, and may be an electrical circuit that executes software commands. Thus, various data processing and calculations described below may be performed. The processor 130 may be, e.g., an electronic control unit (ECU), a micro controller unit (MCU), or other subcontrollers mounted in the vehicle.

The processor 130 may acquire the coolant temperature, the engine rotation speed (RPM), the vehicle speed, the engine torque, and a first target coolant temperature from the sensing device 200 or may receive them from a user.

In this embodiment, the first target coolant temperature may be predetermined as an initial target value which is a constant value.

The processor 130 may perform proportional integral (PI) control to calculate a second target coolant temperature for controlling the coolant temperature to reach the first target coolant temperature.

In this embodiment, the PI control is a logic for deriving a new target value through differentiation and integration such that a current value reaches a predetermined target value. In other words, when an output value is gradually adjusted to be proportional to a difference between the target value and the current value to approach the target value, the output value may be controlled to converge closest to the target value through fine control.

The processor 130 may calculate a target compensation value for compensating for the coolant temperature by using the coolant temperature and the engine torque, and the target compensation value is frequently changed depending on changes in the coolant temperature and the engine torque.

The processor 130 may calculate the first required fan rotation speed for controlling the cooling fan 400 by performing the PI control based on the second target coolant temperature and the target compensation value.

The processor 130 may calculate a fan rotation speed by multiplying an engine rotation speed and a pulley ratio.

The processor 130 may output a second required fan rotation speed by performing the PI control to find a target fan rotation speed such that the calculated fan rotation speed reaches the first required fan rotation speed.

The processor 130 may classify the control regions depending on the coolant temperature and may adjust and output the second required fan rotation speed for each of the control regions.

The processor 130 may classify the control regions into a region having the coolant temperature that is equal to or greater than a predetermined first threshold and smaller than a predetermined second threshold as an intermediate temperature region, a region having the coolant temperature that is below the first threshold as a low temperature region, and a region having the coolant temperature that is higher than the second threshold as a high temperature region.

The processor 130 may reduce the required fan rotation speed calculated based on the PI control in the case of the intermediate temperature region.

The processor 130 may control driving of the cooling fan by reducing the required fan rotation speed by multiplying the required fan rotation speed calculated based on the PI control by a predetermined attenuation coefficient for each vehicle speed. In this embodiment, the predetermined attenuation coefficient may be set to a value of 1 or less.

The processor 130 may control the driving of the cooling fan by using the required fan rotation speed that is inputted from the user in the case of the low temperature region and may control the driving of the cooling fan by using the required fan rotation speed based on the PI control in the case of the high temperature region.

FIG. 2 illustrates a view for describing a method for calculating a third required fan rotation speed according to an embodiment of the present disclosure.

The engine cooling control apparatus 100 classifies the control regions depending on the coolant temperature (S107). In other words, the control regions may be classified into a zone A when the coolant temperature is smaller than the first threshold value (e.g., 60 degrees), a zone B when the coolant temperature is equal to or greater than the first threshold value and smaller than the second threshold value (e.g., 90 degrees), and a zone C when the coolant temperature is equal to or greater than the second threshold value, and the fan rotation speed may be differently applied for each zone.

In the case where the coolant temperature is in the zone A, i.e., the low temperature region, when the cooling fan 400 is slowly rotated in proportion to the vehicle speed, the engine cooling control apparatus 100 controls the cooling fan 400 based on the required fan rotation speed that is directly inputted by a user such that an average temperature of a coolant is reduced without power loss.

In the case where the coolant temperature is in the zone B, i.e., the intermediate temperature region, the engine cooling control apparatus 100 may calculate a final required fan rotation speed (third required fan rotation speed) by multiplying the second required fan rotation speed calculated through the PI control by a predetermined ratio, i.e., attenuation coefficient. In this embodiment, the predetermined attenuation coefficient is limited to a number that is smaller than 1, and the attenuation coefficient for each vehicle speed may be pre-stored by an experimental value. Accordingly, the fan rotation of the cooling fan 400 may be controlled not to be too fast in the intermediate temperature region. Thus, a sudden increase in the fan rotation speed may be prevented.

In the case where the coolant temperature is in the zone C, i.e., the high temperature region, the engine cooling control apparatus 100 may control the cooling fan 400 by using the second required fan rotational speed calculated through the PI control as it is, so that the engine can be quickly cooled by rapidly rotating the cooling fan 400 in the high temperature region.

Figure 3:
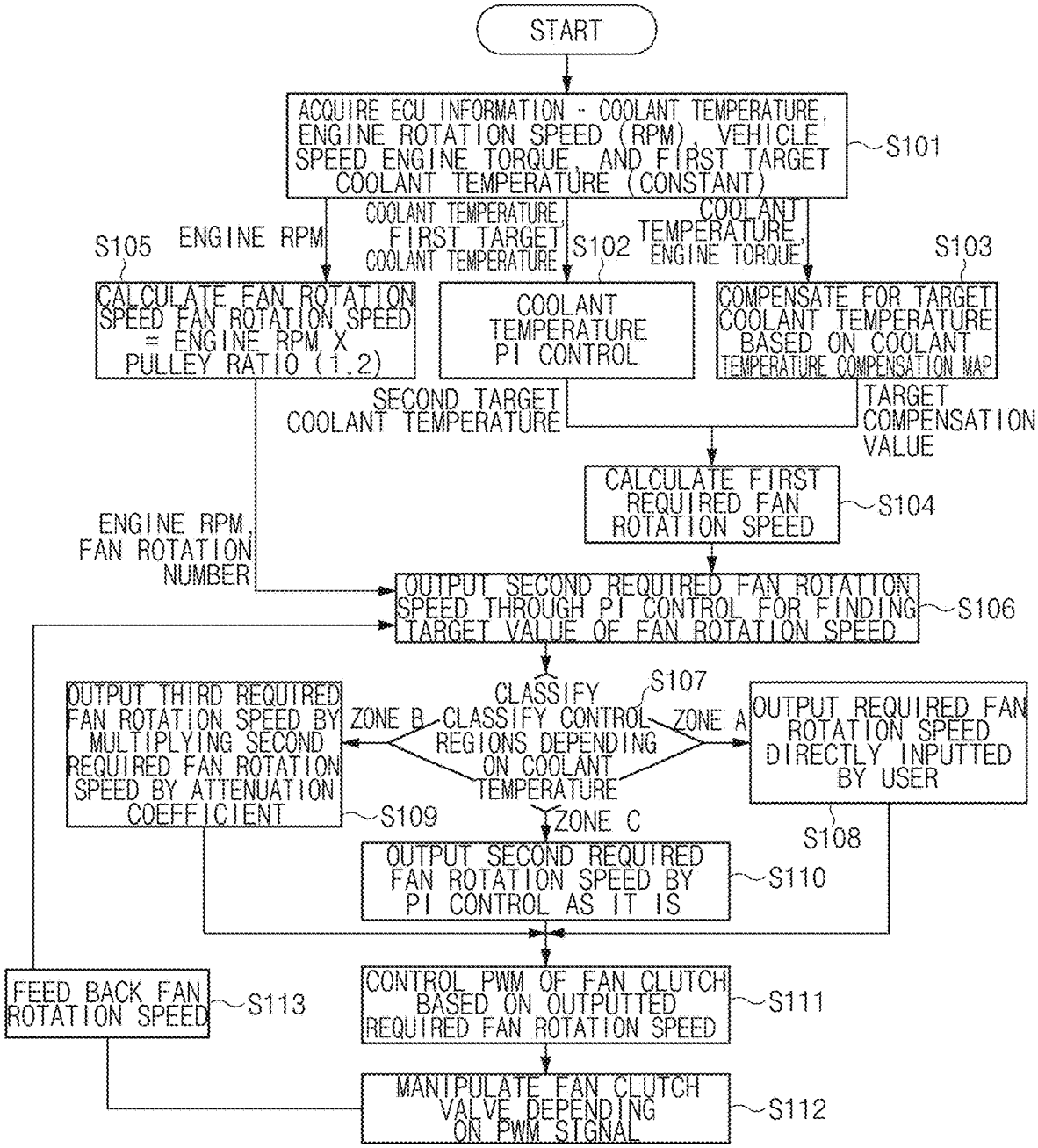
FIG. 3 illustrates an engine cooling control method according to an embodiment of the present disclosure.

Hereinafter, an engine cooling control method according to an embodiment of the present disclosure is described in detail with reference to FIG. FIG. 3 illustrates a flowchart showing an engine cooling control method according to an embodiment.

Hereinafter, it is assumed that the engine cooling control apparatus 100 of the of FIG. 1 performs processes of FIG. 3. In addition, in the description of FIG. 3, operations described as being performed by a device may be understood as being controlled by the processor 130 of the engine cooling control apparatus 100.

Referring to FIG. 3, the engine cooling control apparatus 100 obtain engine manipulation information including a coolant temperature (engine coolant temperature) sensed by the coolant temperature sensor 210, a vehicle speed sensed by the vehicle speed sensor 220, an engine rotation speed (RPM) sensed by the engine speed sensor 230, an engine torque (engine load), and a predetermined first target coolant temperature (S101). In this embodiment, the first target coolant temperature may be predetermined as a constant value by an experiment value.

The engine cooling control apparatus 100 outputs a second target coolant temperature by performing coolant PI control using the coolant temperature and the first target coolant temperature (S102). In other words, the engine cooling control apparatus 100 performs the PI control such that the current coolant temperature reaches the first target coolant temperature, and calculates the second target coolant temperature, which is a target coolant temperature required until the current coolant temperature reaches the first target coolant temperature.

The engine cooling control apparatus 100 outputs a target compensation value for compensating for the target coolant temperature using a coolant temperature compensation map using the coolant temperature and the engine torque (S103). In this embodiment, a target compensation coolant temperature is frequently changed from by the coolant temperature and the engine torque, and thus the fan rotation speed is frequently changed.

The engine cooling control apparatus 100 applies the pre-stored fan rotation speed map by using the second target coolant temperature and the target compensation value and calculates a first required fan rotation speed to control the coolant temperature to reach the compensated second target coolant temperature (S104). The fan rotation speed map may be stored by mapping the fan rotation speed for each target coolant temperature, and the engine cooling control apparatus 100 may apply a target compensation value to the second target coolant temperature, to extract the fan rotation speed corresponding to the target coolant temperature to which the target compensation value is applied from the fan rotation speed map.

The engine cooling control apparatus 100 may calculate the fan rotation speed by using the engine rotation speed (RPM) and the pulley ratio (e.g., 1.2) (S105). In this embodiment, the pulley ratio may indicate an input rotation speed and an output rotation speed of a gear as a gear ratio.

The engine cooling control apparatus 100 may output the second required fan rotation speed through the PI control for finding a target value of the fan rotation speed by using the engine rotation speed, the fan rotation speed, and the first required fan rotation speed (S106). In other words, the engine cooling control apparatus 100 outputs the second required fan rotation speed, which is the fan rotation speed to reach the first required fan rotation speed.

The engine cooling control apparatus 100 classifies the control regions depending on the coolant temperature (S107). In other words, the control regions may be classified into the zone A when the coolant temperature is smaller than the first threshold value, the zone B when the coolant temperature is equal to or greater than the first threshold value and smaller than the second threshold value, and the zone C when the coolant temperature is equal to or greater than the second threshold value, and the fan rotation speed may be differently for each zone.

First, when the coolant temperature is in the zone A, i.e., in the low temperature region, the engine cooling control apparatus 100 may output the required fan rotation speed that is directly inputted by the user. In other words, in the zone A, when the cooling fan 400 is slowly rotated in proportion to the vehicle speed, an average temperature of the coolant may be reduced without loss of power, and resistance may be reduced during driving.

In the case where the coolant temperature is in the zone B, i.e., the intermediate temperature region, the engine cooling control apparatus 100 may calculate a third required fan rotation speed by multiplying the second required fan rotation speed calculated through the PI control in step S106 by an attenuation coefficient, which is a predetermined ratio (S109). In this embodiment, the predetermined attenuation coefficient is limited to a number smaller than 1, and the attenuation coefficient for each vehicle speed may be pre-stored depending on an experimental value. As such, the third required fan rotation speed may become smaller than the second required fan speed by multiplying the second required fan rotation speed by an attenuation coefficient of 1 or less to calculate the third required fan rotation speed, and thus the fan rotation of the cooling fan 400 may be controlled not too fast to prevent a sudden increase in the fan rotation speed in the intermediate temperature region.

In the case where the coolant temperature is in the zone C, i.e., the high temperature region, the engine cooling control apparatus 100 may use the second required fan rotation speed calculated through the PI control in step S106 as it is (S110).

In this high temperature range, the engine must be cooled quickly, so the fan rotation speed must be increased. Accordingly, in the high temperature region, the cooling fan 400 is rapidly driven by using the second required fan rotation speed, which is a fast rotation speed.

Accordingly, the engine cooling control apparatus 100 may control a pulse width modulation (PWM) of the electronic fan clutch 300 based on the required fan rotation speed that is outputted for each region in steps S108, S109, and S110 (S111). Subsequently, the electronic fan clutch 300 controls a fan clutch valve such that the rotation speed of the cooling fan 400 that is outputted from the engine cooling control apparatus 100 reaches the required fan rotation speed (S112). Thereafter, the fan rotation speed is fed back and applied to the step S106 (S113), and the engine cooling control apparatus 100 may perform the PI control by using the fed-back fan rotation speed.

As such, according to the present disclosure, the control regions may be classified depending on an engine coolant temperature into the zone A, where the coolant temperature is smaller than a predetermined reference value, for performing control by directly inputting a target speed. The control regions may be also classified depending on an engine coolant temperature into the zone B, where the coolant temperature is at an intermediate level, for outputting the final required fan rotation speed by multiplying the required fan rotation speed generated by the PI control by the attenuation coefficient. The control regions may be also classified depending on an engine coolant temperature into the zone C, where the coolant temperature reaches the target coolant temperature, for performing control such that the required fan rotation speed generated by the PI control is used as it is. Thus, a sudden change in the cooling fan speed may be prevented before reaching the target coolant temperature.

FIG. 4 illustrates an example of a screen of an intermediate speed control map for a cooling fan of an engine cooling control apparatus according to an embodiment of the present disclosure.

Referring to FIG. 4, for example, when the coolant temperature is 80 degrees and the vehicle speed is 60 km/h, it corresponds to the zone B, and the cooling fan 400 may be controlled by using the final required fan speed (third required fan speed) calculated by multiplying the requested fan speed calculated by the PI control by the attenuation coefficient.

In addition, when the coolant temperature is 50 degrees and the vehicle speed is 40 km/h, it corresponds to the zone A, and the engine may be cooled by controlling the cooling fan 400 such that its speed reaches the required fan rotation speed (e.g., 200) that is directly inputted by the user.

As such, according to the present disclosure, when the target coolant temperature is inputted, the required fan rotation speed for controlling a current coolant temperature to reach the target coolant temperature may be calculated by comparing the target coolant temperature and the current coolant temperature, and the cooling fan 400 may be driven by correcting the required fan rotation speed depending on the coolant temperature. In particular, when the coolant temperature is in an intermediate temperature range, unnecessary fan driving may be minimized by reducing the required fan rotation speed in detail to drive it. As such, power consumed for unnecessary fan driving may be used for driving the vehicle by minimizing unnecessary fan driving. Thus, fuel efficiency may be improved, acceleration may be increased, and hill climbing ability may be improved.

Figure 5:
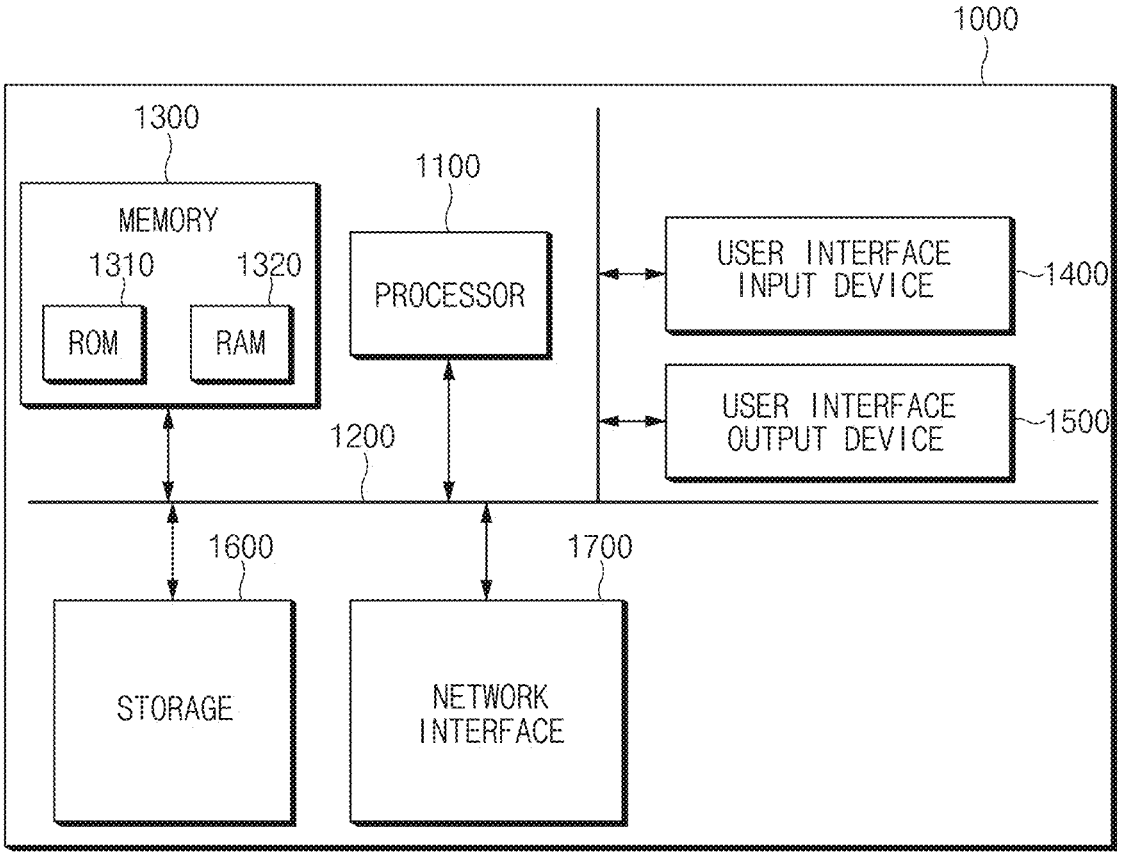
FIG. 5 illustrates a computing system according to an embodiment of the present disclosure.

FIG. 5 illustrates a computing system according to an embodiment of the present disclosure.

Referring to FIG. 5, the computing system 1000 includes at least one processor 1100 connected through a bus 1200, a memory 1300, a user interface input device 1400, a user interface output device 1500, and a storage 1600, and a network interface 1700.

The processor 1100 may be a central processing unit (CPU) or a semiconductor device that performs processing on commands stored in the memory 1300 and/or the storage 1600. The memory 1300 and the storage 1600 may include various types of volatile or nonvolatile storage media. For example, the memory 1300 may include a read only memory (ROM) and a random access memory (RAM).

Accordingly, steps of a method or algorithm described in connection with the specific embodiments disclosed herein may be directly implemented by hardware, a software module, or a combination of the two, executed by the processor 1100. The software module may reside in a storage medium (i.e., the memory 1300 and/or the storage 1600) such as a RAM memory, a flash memory, a ROM memory, a EPROM memory, a EEPROM memory, a register, a hard disk, a removable disk, and a CD-ROM.

A storage medium is coupled to the processor 1100, which can read information from and write information to the storage medium. In another embodiment, the storage medium may be integrated with the processor 1100. The processor and the storage medium may reside within an application specific integrated circuit (ASIC). The ASIC may reside within a user terminal. Alternatively, the processor and the storage medium may reside as separate components within the user terminal.

The above description is merely illustrative of the technical idea of the present disclosure, and those having ordinary skill in the art to which the present disclosure pertains may make various modifications and variations without departing from the essential characteristics of the present disclosure.

Therefore, the specific embodiments disclosed in the present disclosure are not intended to limit the technical ideas of the present disclosure, but to explain them. The scope of the technical ideas of the present disclosure is not limited by these specific embodiments. The protection range of the present disclosure should be interpreted by the claims below, and all technical ideas within the equivalent range should be interpreted as being included in the scope of the present disclosure.

What is claimed is:

1. An engine cooling control apparatus comprising:

a processor configured to calculate a required fan rotation speed for controlling a cooling fan based on proportional integral (PI) control; and a storage configured to store data acquired by the processor and an algorithm for driving the processor, wherein the processor classifies a plurality of control regions depending on a coolant temperature and adjusts and outputs the required fan rotation speed for each of the control regions, and wherein the processor controls driving of the cooling fan by using a required fan rotation speed that is inputted by a user in a case of a low temperature region where the coolant temperature is smaller than a predetermined first threshold value.

2. The engine cooling control apparatus of claim 1, wherein the processor classifies the control regions into:

an intermediate temperature region where the coolant temperature is equal to or greater than the first threshold value or smaller than a predetermined second threshold value;

the low temperature region where the coolant temperature is smaller than the first threshold value; and a high temperature region where the coolant temperature is equal to or greater than the second threshold value.

3. The engine cooling control apparatus of claim 2, wherein the processor reduces a required fan rotation speed calculated based on the PI control in the case of the intermediate temperature region.

4. The engine cooling control apparatus of claim 3, wherein the processor reduces the required fan rotation speed by multiplying the required fan rotation speed calculated based on the PI control by a predetermined attenuation coefficient for each vehicle speed.

5. The engine cooling control apparatus of claim 4, wherein the attenuation coefficient has a value of 1 or less.

6. The engine cooling control apparatus of claim 1, wherein the processor outputs a pulse width modulation (PWM) signal for driving an electronic fan clutch depending on the required fan rotation speed.

7. The engine cooling control apparatus of claim 1, wherein the processor controls the driving of the cooling fan by using the required fan rotation speed based on the PI control in the case of the high temperature region.

8. The engine cooling control apparatus of claim 7, wherein the processor calculates a fan rotation speed of the cooling fan by using an engine rotation speed and a pulley ratio.

9. A vehicle system comprising:

an engine cooling control apparatus configured to calculate a required fan rotation speed for controlling a cooling fan based on proportional integral (PI) control, to classify a plurality of control regions depending on a coolant temperature, and to adjust and output the required fan rotation speed for each of the control regions; and an electronic fan clutch configured to output a control signal for controlling a cooling fan depending on the required fan rotation speed, and wherein the engine cooling control apparatus controls driving of the cooling fan by using a required fan rotation speed that is inputted by a user in the case of a low temperature region where the coolant temperature is smaller than a predetermined first threshold value.

10. The vehicle system of claim 9, wherein the engine cooling control apparatus classifies the control regions into:

an intermediate temperature region where the coolant temperature is equal to or greater than the first threshold value or smaller than a predetermined second threshold value;

the low temperature region where the coolant temperature is smaller than the first threshold value; and a high temperature region where the coolant temperature is equal to or greater than the second threshold value.

11. The vehicle system of claim 10, wherein the engine cooling control apparatus further:

reduces the required fan rotation speed calculated based on the PI control in the case of the intermediate temperature region;

and controls the driving of the cooling fan by using the required fan rotation speed based on the PI control in the case of the high temperature region.

12. An engine cooling control method comprising:

calculating a required fan rotation speed for controlling a cooling fan based on proportional integral (PI) control;

classifying a plurality of control regions depending on a coolant temperature; and adjusting and outputting the required fan rotation speed for each of the control regions, wherein the adjusting and outputting of the required fan rotation speed includes controlling driving of the cooling fan by using a required fan rotation speed that is inputted by a user in the case of a low temperature region where the coolant temperature is smaller than a predetermined first threshold value.

13. The engine cooling control method of claim 12, wherein the classifying of the control regions depending on the coolant temperature includes:

determining a region where the coolant temperature is equal to or greater than the first threshold value or smaller than a predetermined second threshold value as an intermediate temperature region;

determining a region where the coolant temperature is smaller than the first threshold value as the low temperature region; and determining a region where the coolant temperature is equal to or greater than the second threshold value as a high temperature region.

14. The engine cooling control method of claim 13, wherein the adjusting and outputting of the required fan rotation speed further includes reducing the required fan rotation speed calculated based on the PI control in the case of the intermediate temperature region;

and controlling the driving of the cooling fan by using the required fan rotation speed based on the PI control in the case of the high temperature region.

15. The engine cooling control method of claim 14, wherein the reducing of the required fan rotation speed includes reducing the required fan rotation speed by multiplying the required fan rotation speed calculated based on the PI control by a predetermined attenuation coefficient for each vehicle speed.

16. The engine cooling control method of claim 15, wherein the attenuation coefficient has a value of 1 or less.

17. The engine cooling control method of claim 12, wherein a pulse width modulation (PWM) signal for driving an electronic fan clutch is outputted depending on the required fan rotation speed.

* * * * *